US006575452B2

(12) United States Patent
Hsiao et al.

(10) Patent No.: US 6,575,452 B2
(45) Date of Patent: Jun. 10, 2003

(54) MECHANISM FOR AUTOMATICALLY AND ADJUSTABLY FEEDING SHEETS

(75) Inventors: Sidney Hsiao, Changhua (TW); Jones Wu, Taipei (TW); Jackly Liu, Taipei (TW); Julian Liu, Taichung (TW)

(73) Assignee: Silitek Corporation, Taipei (TW)

( * ) Notice: Subject to any disclaimer, the term of this patent is extended or adjusted under 35 U.S.C. 154(b) by 95 days.

(21) Appl. No.: 09/845,696

(22) Filed: Apr. 30, 2001

(65) Prior Publication Data

US 2002/0158403 A1 Oct. 31, 2002

(51) Int. Cl.[7] ..... B65H 3/52
(52) U.S. Cl. ..... 271/121; 271/124
(58) Field of Search ..... 271/121, 124

(56) References Cited

U.S. PATENT DOCUMENTS 6,318,716 B1 * 11/2001 Okuda ..... 271/121
6,331,002 B1 * 12/2001 Yoshino et al. ..... 271/124 X
6,398,209 B1 * 6/2002 Sato ..... 271/124

* cited by examiner

*Primary Examiner*—David H. Bollinger
(74) *Attorney, Agent, or Firm*—Volpe and Koenig, P.C.

(57) ABSTRACT

A mechanism for automatically and adjustably feeding sheets is provided. The mechanism includes a paper dividing plate, a roller for picking the sheets, wherein a channel is formed between the paper dividing plate and the roller, and the sheets are driven by friction between the roller and the sheets to pass through the channel, and a controller having a first end engaged with the paper dividing plate and a second end as a fulcrum for the paper dividing plate, wherein when an unbalanced force from the roller is applied on the paper dividing plate, the paper dividing plate pivots on the fulcrum to adjust the unbalanced force.

18 Claims, 4 Drawing Sheets

MECHANISM FOR AUTOMATICALLY AND ADJUSTABLY FEEDING SHEETS

FIELD OF THE INVENTION

The present invention relates to a sheets feeding mechanism, and more particularly to a sheets feeding mechanism having a ball-and-socket joint structure.

BACKGROUND OF THE INVENTION

Automatic document feeders are generally applied in office machines, e.g. facsimile machines, copy machines, printers or scanners.

FIG. 1 is a schematic view showing a conventional automatic document feeder. The conventional automatic document feeder includes a main body 11, a roller 12, a paper dividing plate 13 and a compressible spring 14. The sheets of the document are fed from a document-feeding tray to the paper dividing plate 13 one by one and further to a document-receiving tray of the office machine for the following process. The feeding is driven by the friction between the sheets and the roller 12 and regulated by the compressible spring 14.

The compressible spring 14 is used for supporting the paper dividing plate 13 and regulating the feeding of the sheets in the conventional automatic document feeder.

However, the conventional automatic document feeder has several drawbacks. When the paper dividing plate 13 is insufficiently supported by the compressible spring 14 or the force from the roller 12 is not uniformly applied on the paper dividing plate 13, multiple sheets are fed once from the document-feeding tray to the document-receiving tray. Furthermore, the tolerance is controlled with difficulty in the fabrication and/or the assembly process of the conventional automatic document feeder. When the tolerance is not well controlled, the force from the roller 12 would not be uniformly applied on the paper dividing plate 13, so that multiple sheets would be fed once from the document-feeding tray to the document-receiving tray.

Therefore, the present invention provides a mechanism for automatically and adjustably feeding sheets to overcome the foresaid drawbacks of the conventional automatic document feeders.

SUMMARY OF THE INVENTION

It is an object of the present invention to provide a mechanism for automatically and adjustably feeding sheets.

In accordance with the present invention, the mechanism includes a paper dividing plate, a roller for picking the sheets and a controller.

A channel is formed between the paper dividing plate and the roller, and the sheets are driven by friction between the roller and the sheets to pass through the channel.

The controller has a first end engaged with the paper dividing plate and a second end as a fulcrum for the paper dividing plate.

In accordance with the present invention, when an unbalanced force from the roller is applied on the paper dividing plate, the paper dividing plate pivots on the fulcrum to adjust the unbalanced force.

In addition, the mechanism further includes a compressible spring engaged with the paper dividing plate, wherein when the sheets pass through the channel, said sheets are compressed by the paper dividing plate through the compressible spring to be closely in contact with the roller.

The compressible spring and said controller are in a first side of the paper dividing plate, and the roller is on a second side of the paper dividing plate.

The second end of the controller and a main body of the mechanism form a ball-and-socket joint structure for promoting the controller to pivot, wherein the paper dividing plate is further driven by the controller to pivot on at least two dimensions.

In accordance with the present invention, the ball-and-socket joint structure further includes a ball and a seat.

The ball is disposed at the second end of the controller, and the seat included in the main body of the mechanism is used for receiving the ball and having a smooth sphere in contact with the ball in the interior of the seat, wherein the ball smoothly moves around in the smooth sphere.

In addition, the seat further includes two holding elements disposed oppositely and forming a bottle-shaped gap for receiving the ball.

The bottle-shaped gap has a funnel-shaped opening for guiding the ball into the bottle-shaped gap.

Furthermore, the paper dividing plate has a rubber slice on one side of the paper dividing plate facing the roller for promoting the sheets to be closely contacted with the roller.

Preferably, the controller and the paper dividing plate are integrally formed.

Preferably, the sheets are scan manuscripts.

Preferably, the device could be a facsimile machine, a copy machine and a scanner.

It is another object of the present invention to provide a mechanism for automatically and adjustably feeding sheets.

The mechanism includes a paper dividing plate, a roller and a ball-and-socket joint structure.

The roller is used for picking the sheets, wherein a channel is formed between the paper dividing plate and the roller, and the sheets are driven by friction between the roller and said sheets to pass through the channel.

The ball-and-socket joint structure is engaged with the paper dividing plate.

In accordance with present invention, when an unbalanced force from the roller is applied on the paper dividing plate, the ball-and-socket joint structure promotes the—paper dividing plate to move and adjust the unbalanced force.

The mechanism further includes a compressible spring engaged with the paper dividing plate, wherein when the sheets pass through the channel, the sheets are compressed by the paper dividing plate through the compressible spring to be closely in contact with the roller.

In accordance with present invention, the ball-and-socket joint structure pivots on at least two dimensions.

In addition, the ball-and-socket joint structure further includes a ball and a seat.

The ball is engaged with the paper dividing plate, and the seat included in a main body of the mechanism for receiving the ball and having a smooth sphere contacting with the ball in the interior of the seat, wherein the ball smoothly moves around in the smooth sphere.

In addition, the mechanism further includes two holding elements disposed oppositely and forming a bottle-shaped gap for receiving the ball.

The bottle-shaped gap has a funnel-shaped opening for guiding the ball into the bottle-shaped gap, and an arc-shaped neck for the ball smoothly moving around therein.

Preferably, the ball and the paper dividing plate are integrally formed.

Furthermore, the paper dividing plate has a rubber slice on one side of the paper dividing plate facing the roller for promoting the sheets closely contacted with the roller.

The present invention may best be understood through the following descriptions with reference to the accompanying drawings, in which:

BRIEF DESCRIPTION OF THE DRAWINGS

FIG. 4(*b*) is a top view showing the magnified A–A' region in FIG. 4(*a*).

DETAILED DESCRIPTION OF THE PREFERRED EMBODIMENTS

Figure 1:
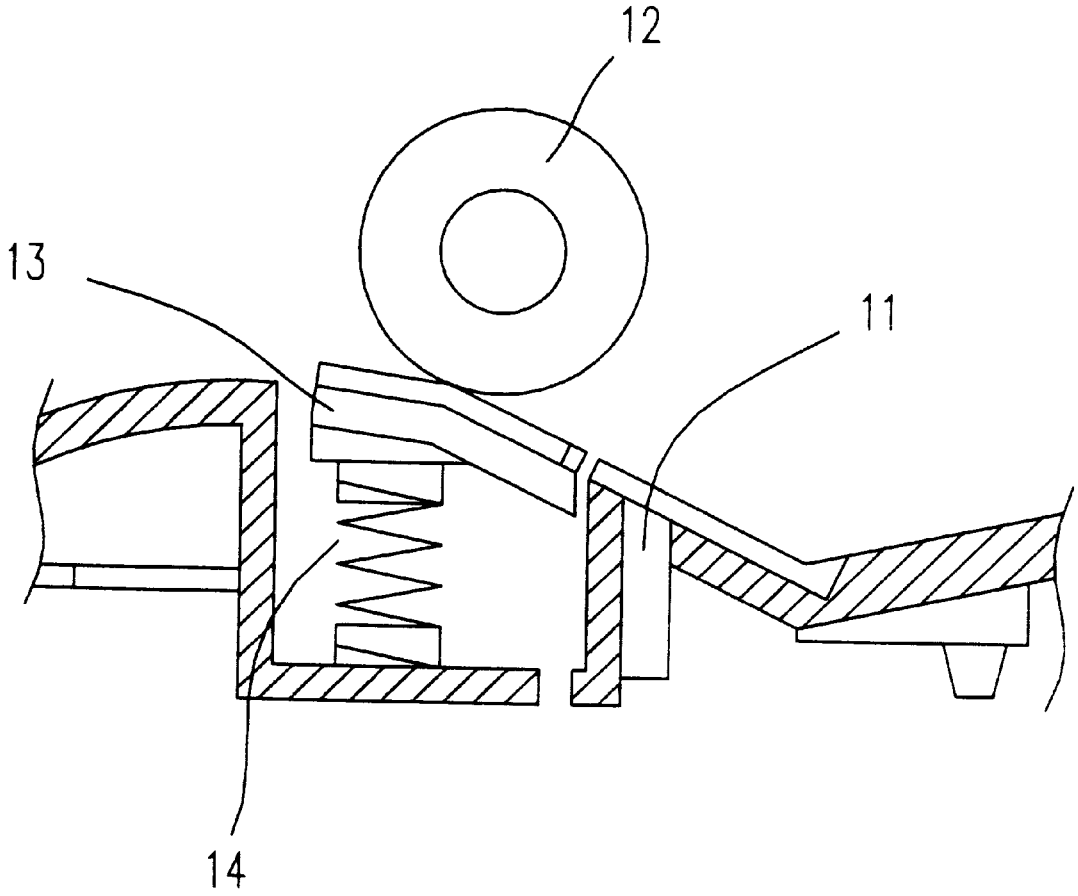
Fig. 1(PRIOR ART)
FIG. 1 is a schematic view showing the conventional automatic document feeder.
Figure 2:
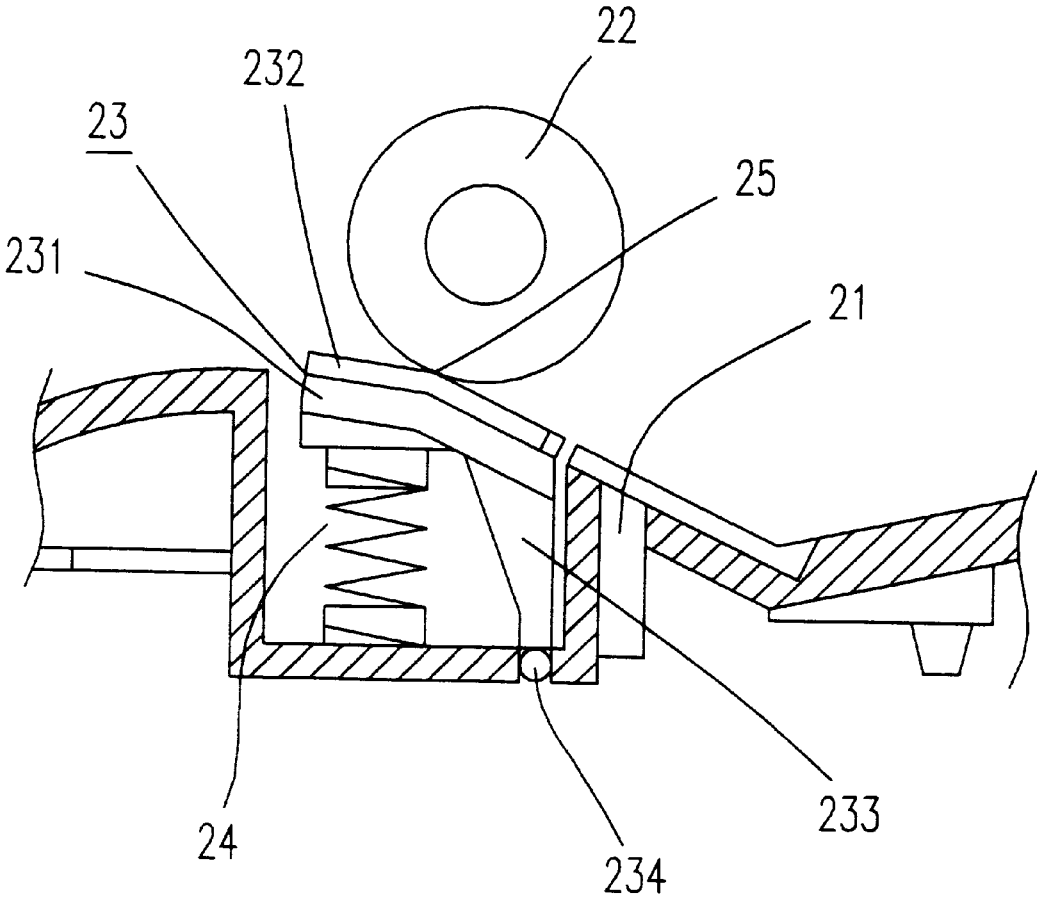
FIG. 2 is a schematic view showing the mechanism according to the preferred embodiment of the present invention.
Figure 3A:
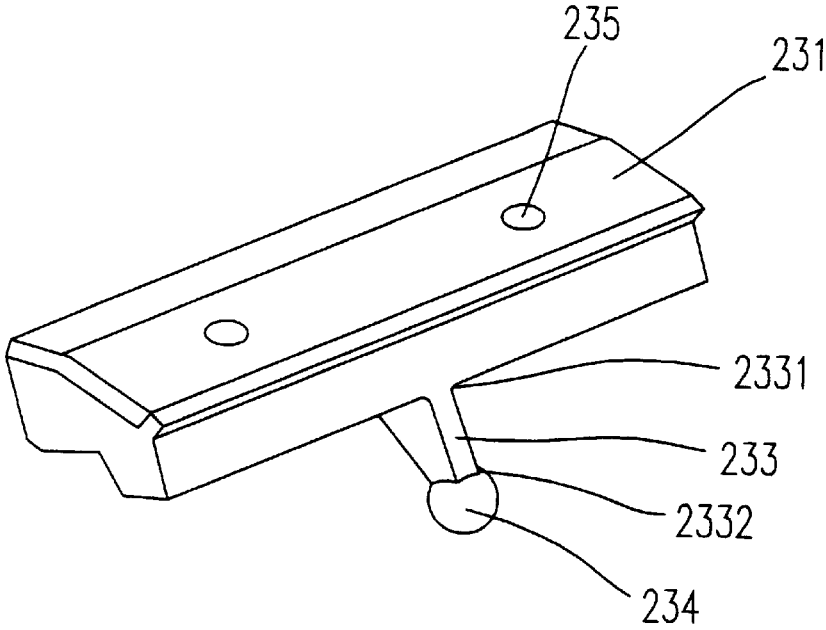
FIGS. 3(*a*) and (*b*) are schematic views showing the paper dividing plate of the mechanism according to the preferred embodiment of the present invention.
Figure 3B:
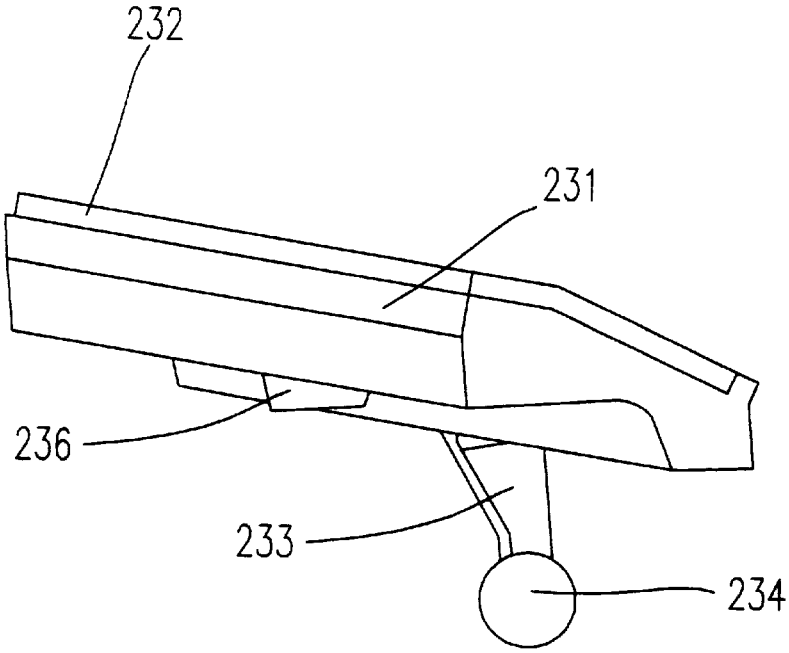

Please refer to FIGS. 2 to 3(*b*). The mechanism provided by the present invention includes a main body 21, a roller 22, a paper dividing regulator 23 and a compressible spring 24. The paper dividing regulator 23 includes a paper dividing plate 231, a rubber slice 232 and a controller 233. Two positioning elements 235 are disposed on the paper dividing plate 231 for guiding the glued rubber slice 232 to rapidly combine with the paper dividing plate 231. A positioning receptacle 236 is disposed below the paper dividing plate 231 for receiving and positioning the compressible spring 24. The controller 233 has a first end 2331 engaged with the paper dividing plate 231 and a second end 2332 engaged with a ball 234. The assembly of the foresaid elements is shown in FIGS. 3(*a*) and (*b*).

Figure 4A:
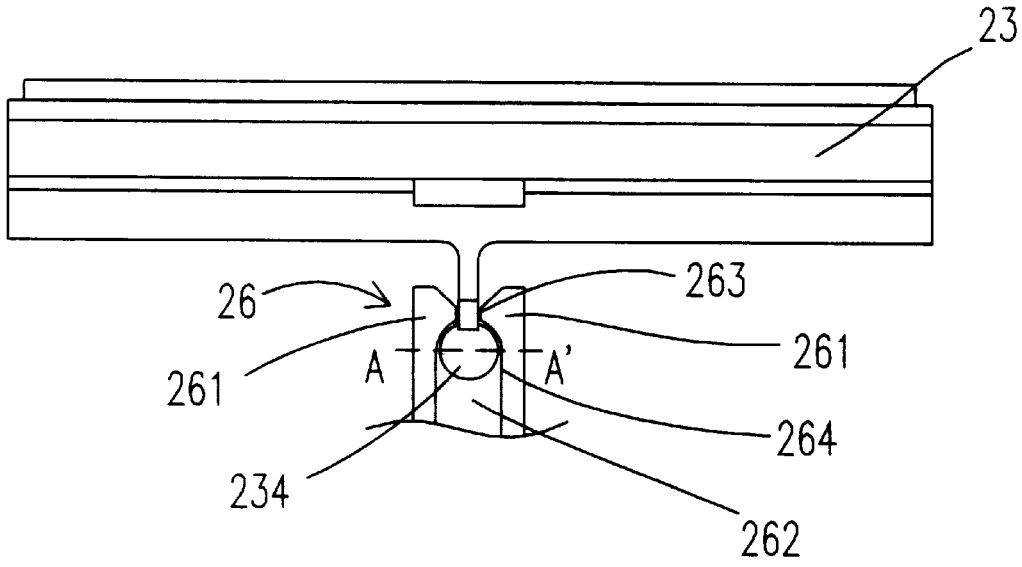
FIG. 4(*a*) is a schematic view assembly of the paper dividing plate and the ball-and-socket joint structure according to the preferred embodiment of the present invention.
Figure 4B:
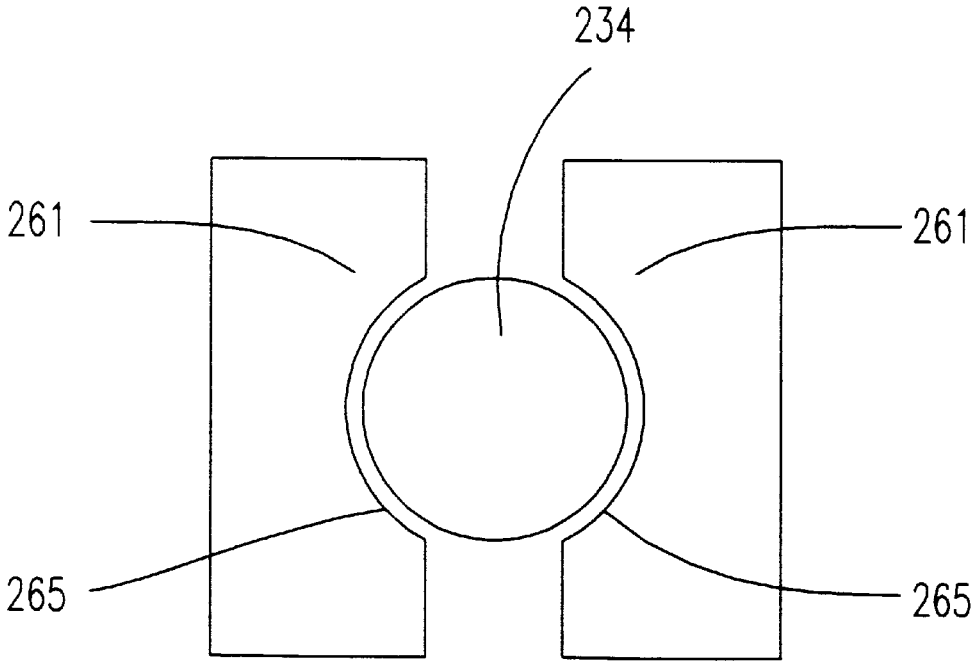

Please refer to FIGS. 4(*a*) and (*b*). A seat 26 included in the main body 21 and the ball 234 form a ball-and-socket joint structure. The seat 26 includes two holding elements 261 disposed oppositely, and the two holding elements 261 form a bottle-shaped gap for receiving the ball 234. The bottle-shaped gap has a funnel-shaped opening 263. The opening 263 of the bottle-shaped gap is dilated by the ball 234, and the ball 234 is guided by the funnel-shaped opening 263 to enter the main portion 264 of the bottle-shaped gap. Therefore, the assembly of the ball 234 and the seat 26 is formed. In addition, the bottle-shaped gap has an arc-shaped neck portion 265 for the ball 234 smoothly moving around therein.

Because of the motion of the ball-and-socket joint structure, the controller 233 pivots in the seat 26, and the paper dividing plate 231 is driven by the controller 233 to move around.

Please refer to FIG. 2. The sheets of the document are one by one fed from a document-feeding tray into the channel 25 formed by the paper dividing plate 231 and the roller 22, and further to a document-receiving tray of the office machine for the following process. Because the sheets are closely in contact with the roller 22 by the auxiliary rubber slice 232, the feeding is driven by the friction between the sheets and the roller 22, and the feeding is regulated by the compressible spring 24.

If the force from the roller 22 is uniformly applied on the paper dividing plate 231 during the sheets feeding process, the sheets are fed one by one through the channel 25 and the slant feeding and multiple sheets once fed will not occur.

However, the tolerance is controlled with difficulty in the fabrication and/or the assembly process of the sheets feeding mechanism, so that sometimes the force from the roller 22 is not uniformly applied on the paper dividing plate 231. In accordance with the present invention, the paper dividing plate 231 could be driven by the motion of the ball-and-socket joint structure to move around, and the unbalanced force applied on the paper dividing plate 231 is adjusted. Hence, the slant feeding and multiple sheets once fed are overcome.

In another preferred embodiment of the present invention, the paper dividing plate 231, the controller 233 and the ball 234 are integrally formed, and thus the fabrication process and the assembly of the sheets feeding mechanism would be simplified.

In addition, the ball-and-socket joint structure is simply assembled by the ball 234 and the seat 26.

Furthermore, the paper dividing plate 231 is supported by the controller 233 and the compressible spring 24, so that the compressible spring 24 could be suppler and the compressed distance could be longer than the conventional compressible spring. Hence, the compressible spring 24 could compensate the tolerance of the fabrication process and the assembly of the present invention, and the force applied on the paper dividing plate 231 would be uniform.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A mechanism for automatically and adjustably feeding sheets, comprising:

a paper dividing plate;

a roller for picking said sheets, wherein a channel is formed between said paper dividing plate and said roller, and said sheets are driven by friction between said roller and said sheets to pass through said channel; and a controller having a first end engaged with said paper dividing plate and a second end as a fulcrum for said paper dividing plate, wherein said second end of said controller and a main body of said mechanism form a ball-and-socket joint structure for promoting said controller to pivot, and said paper dividing plate is further driven by said controller to pivot on at least two dimensions, wherein when an unbalanced force from said roller is applied on said paper dividing plate, said paper dividing plate pivots on said fulcrum to adjust said unbalanced force.

2. The mechanism according to claim 1, further comprising a compressible spring engaged with said paper dividing plate, wherein when said sheets pass through said channel, said sheets are compressed by said paper dividing plate through said compressible spring to be closely in contact with said roller.

3. The mechanism according to claim 2, wherein said compressible spring and said controller are in a first side of said paper dividing plate, and said roller is on a second side of said paper dividing plate.

4. The mechanism according to claim 1, wherein said ball-and-socket joint structure further comprises:

a ball disposed at said second end of said controller; and a seat comprised in said main body of said mechanism for receiving said ball and having a smooth sphere in contact with said ball in the interior of said seat, wherein said ball smoothly moves around in said smooth sphere.

5. The mechanism according to claim 4, wherein said seat further comprises two holding elements disposed oppositely and forming a bottle-shaped gap for receiving said ball.

6. The mechanism according to claim 5, wherein said bottle-shaped gap has a funnel-shaped opening for guiding said ball into said bottle-shaped gap.

7. The mechanism according to claim 1, wherein said paper dividing plate has a rubber slice on one side of said paper dividing plate facing said roller for promoting said sheets to be closely in contact with said roller.

8. The mechanism according to claim 1, wherein said controller and said paper dividing plate are integrally formed.

9. The mechanism according to claim 1, wherein said sheets are scan manuscripts.

10. The mechanism according to claim 9, wherein said mechanism is used in a device selected from a group of a facsimile machine, a copy machine and a scanner.

11. A mechanism for automatically and adjustably feeding sheets, comprising:

a paper dividing plate;

a roller for picking said sheets, wherein a channel is formed between said paper dividing plate and said roller, and said sheets are driven by friction between said roller and said sheets to pass through said channel; and a ball-and-socket joint structure engaged with said paper dividing plate, wherein when an unbalanced force from said roller is applied on said paper dividing plate, said ball-and-socket joint structure promotes said paper dividing plate to move and adjust said unbalanced force.

12. The mechanism according to claim 11, further comprising a compressible spring engaged with said paper dividing plate, wherein when said sheets pass through said channel, said sheets are compressed by said paper dividing plate through said compressible spring to be closely in contact with said roller.

13. The mechanism according to claim 12, wherein said ball-and-socket joint structure pivots on at least two dimensions.

14. The mechanism according to claim 13, wherein said ball-and-socket joint structure further comprises:

a ball engaged with said paper dividing plate; and a seat comprised in a main body of said mechanism for receiving said ball and having a smooth sphere in contact with said ball in the interior of said seat, wherein said ball smoothly moves around in said smooth sphere.

15. The mechanism according to claim 14, further comprising two holding elements disposed oppositely and forming a bottle-shaped gap for receiving said ball.

16. The mechanism according to claim 15, wherein said bottle-shaped gap has a funnel-shaped opening for guiding said ball into said bottle-shaped gap, and an arc-shaped neck for said ball smoothly moving around therein.

17. The mechanism according to claim 14, wherein said ball and said paper dividing plate are integrally formed.

18. The mechanism according to claim 11, wherein said paper dividing plate has a rubber slice on one side of said paper dividing plate facing said roller for promoting said sheets to be closely in contact with said roller.

* * * * *